United States Patent [19]

Grioni

[11] 4,180,163

[45] Dec. 25, 1979

[54] CYLINDRICAL CONTAINER

[76] Inventor: Libero Grioni, Via San Francesco d'Assisi, 9, Trezzano Sul Naviglio (Milan), Italy

[21] Appl. No.: 959,615

[22] Filed: Nov. 13, 1978

[30] Foreign Application Priority Data

Nov. 18, 1977 [IT] Italy ..... 22769/77[U]

[51] Int. Cl.[2] ..... A45D 40/00

[52] U.S. Cl. ..... 206/385; 132/79 C

[58] Field of Search ..... 206/385; 132/79 C, 88.7, 132/88.5; 401/78, 75, 71, 72, 68

[56] References Cited

U.S. PATENT DOCUMENTS

| | | | |
|---|---|---|---|
| 1,504,217 | 8/1924 | Coryell | 132/79 C |
| 1,865,639 | 7/1932 | Most | 132/79 C |
| 1,953,251 | 4/1934 | Mitchell | 132/79 C |
| 3,298,509 | 1/1967 | Hultgren | 132/79 C |
| 3,393,036 | 7/1968 | Fuglsang-Madsen | 206/385 X |
| 3,991,775 | 11/1976 | Spatz | 132/79 C |

*Primary Examiner*—Joseph Man-Fu Moy
*Attorney, Agent, or Firm*—Bucknam and Archer

[57] ABSTRACT

A cylindrical container for containing lip-sticks and the like, comprises a first cylindrical member, which is the innermost one, is provided, at the upper portion, with a small cup for containing, the lower portion of the lip-stick, and laterally, axially and all along the length thereof, with a projecting nose; a second cylindrical member has a slot for insertion and sliding of the projecting nose of the first cylindrical member and, on the other outer surface thereof, diametrically and at the lower end with two projecting and slanted nose members; a third cylindrical member, on its inner surface, has two helical slots crossing one another, for insertion of the two projecting nose members of the second cylindrical member; a fourth cylindrical member, which serves as the handle of the containers, has a height lower than that of the other cylindrical members andis fixed to the lower portion of the first cylindrical member.

5 Claims, 6 Drawing Figures

CYLINDRICAL CONTAINER

The present invention relates to a cylindrical container, particularly effective to contain lipsticks, cocoa-butter, shaving soap or sticks and the like cosmetic products.

As it is known, for housing beauty products, such as lipsticks, cocoa-butter, shaving soap or sticks and the like cosmetic products, are nowadays used containers consisting of a number of coaxial cylindrical elements which are located in such a way that, by imposing onto the outer cylindrical member a rotation movement, a vertical movement of the inner cylinder is caused and hence the supplying, for a length, of the product to be used.

However the known containers present some drawbacks which limitate use of general type thereof, such as, for example, a difficult loading of the product, the rotating of the contained product together with the supporting cylinder and so on.

Accordingly it is an object of the present invention to provide a cylindrical container for the thereinabove indicated products which is free of the mentioned drawbacks and which allows for a quick and easy loading of the product to be obtained, while preventing said product from rotating during the vertical movement.

The Applicant has found that this object is achieved by a cylindrical container consisting of four coaxial hollow cylindrical members inserted into one another and effective to mutually slide, of which:

the first cylindrical member, the innermost one, is provided, at the upper portion thereof, with a small cup for containing the lower portion of the product to be housed and, laterally, axially and all along the length thereof, with a projecting nose;

the second cylindrical member has an inner diameter greater than the outer diameter of the first cylindrical member thereby keying thereonto, and it is provided, on the inner surface thereof, axially and all along the length thereof, with a slot thereinto inserts and therethrough slides the projecting nose of the first cylindrical member and, on the outer surface thereof, diametrically and at the lower end thereof, with two projecting and slanted nose members;

the third cylindrical member has an inner diameter greater than the outer diameter of the second cylindrical member, thereby keying onto this latter, being provided, on the inner surface thereof, with two helical slots crossing one another, in each said slot inserting one of the two projecting nose members of said second cylindrical member, and the fourth cylindrical member, acting as the handle of the container, having an inner diameter greater than the outer diameter of the third cylindrical member, and having a height lower than that of said cylindrical members and being fixed to the lower portion of the first cylindrical member.

To this end, the lower portion of the first cylindrical member is provided with a step for the fixing of the lower portion of the fourth cylindrical member having a recess mating with said step. A cover member, effective to close the thus formed cylindrical container, is pressure keyed onto the fourth cylindrical member which, to this end, is provided with a perimetrical groove.

The operation of the container according to the present invention is the following:

by maintaining stationary the fourth cylindrical member, i.e. the outermost one acting as a handle, and hence also the first cylindrical member, which is rigid with the fourth cylindrical member and contains the product stick, and rotating the third cylindrical member in one of the two directions (clockwise or anti-clock-wise), the second cylindrical member is caused to axially raise or lower, thereby covering or uncovering, respectively, the product stick.

Obviously, the amount or extension of the axial movement of the second cylindrical member depends on the consumed product amount and the surface to be uncovered.

In order to better understand the structural and functional characteristics of the instant cylindrical container, this container will be thereinbelow described referring to the figures of the accompanying drawings illustrating a preferred exemplificative and not limitative embodiment of the instant container, and in which.

Figure 2:
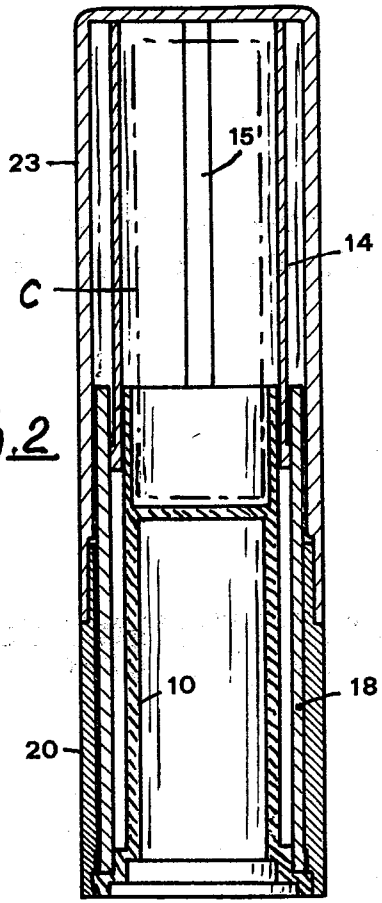
FIG. 2 is a cross-section view of the cylindrical container according to the present invention.
Figure 1:
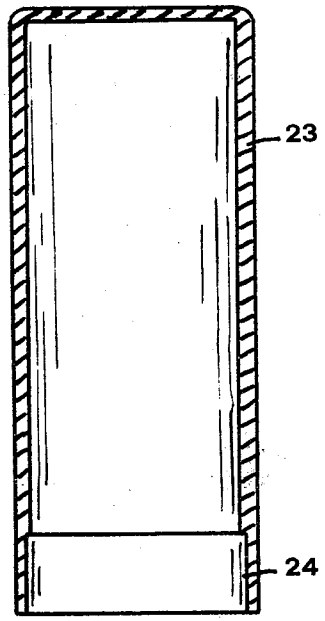
FIG. 1 is a cross-section view of the cover of the cylindrical container according to the present invention.

Referring to the figures, the instant cylindrical container comprises a first cylindrical member (10), the innermost one, provided at the upper portion thereof, with a small cup (11), thereinto is inserted the lower portion of the product stick to be housed. At the base thereof said cylindrical member (10) is perimetrically provided with a collar, formed by two steps (12) and (12') having different outwardly increasing diameters. Furthermore, onto the outer wall of said cylindrical member (10) is formed, axially and all along the length thereof, a projecting nose member (13). The second cylindrical member (14) has an inner diameter greater than the outer diameter of the cylindrical member (10) and is provided, axially and all along the length thereof, with a recess or slot (15) thereinto, upon keying the cylindrical member (14) onto the cylindrical member (10) slidingly inserts the projecting nose member (13).

At the base, said second cylindrical member (14) is provided with two projecting diametrically opposed slanting nose members (16) and (16').

The third cylindrical member (18), which has an inner diameter greater than the outer diameter of the second cylindrical member (14) is provided, on the inner surface thereof, with two helical crossing recesses or slots (17) and (17'). In each said slot (17) and (17') slidingly inserts each said nose member (16) and (16') of the second cylindrical member (14), as the cylindrical member (18) is keyed thereon. The base of the cylindrical member (18) is provided with a perimetrical step (19).

The fourth cylindrical member (20) has a length lesser than that of the other three cylindrical members and an inner diameter greater than the outer diameter of the cylindrical length (18). Said cylindrical member (20)

is provided, at the lower portion thereof, with two recesses (21) and (21'), the outermost of which (21') corresponds and is fixed to the step (12') of the cylindrical member (10), and into the innermost recesses (21) is inserted and slides therein the perimetrical step (19) of the cylindrical member (18). Furthermore the cylindrical member (20) is provided, at the upper portion thereof, with a perimetrical recess or groove (22) formed onto the outer surface thereof.

Onto said groove (22) is pressure keyed the covering member (23) provided, on the inner surface thereof, and all along the free edge, with a seat (24).

The inner diameter of the cylindrical member (18) is equal to or slightly greater than the outer diameter of the step (12).

Figure 6:
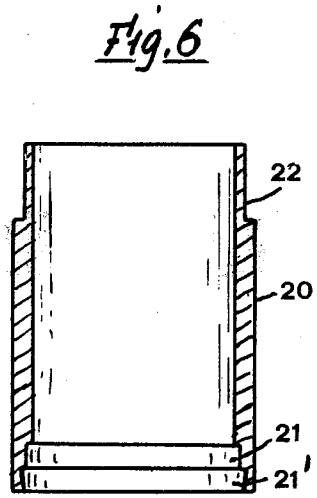
FIG. 6 is a cross-section view of the fourth cylindrical member acting as an outer handle for the instant container.
Figure 5:
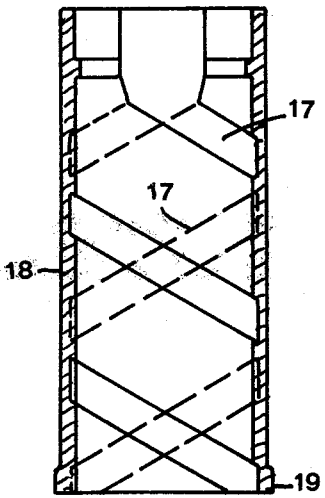
FIG. 5 is a cross-section view of the third cylindrical member.
Figure 4:
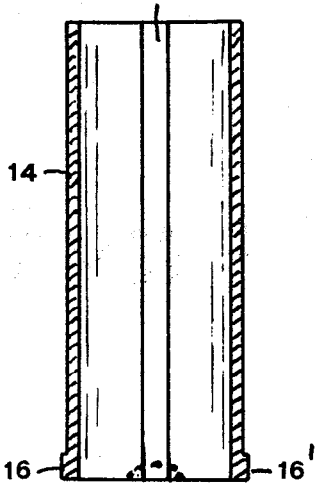
FIG. 4 is a cross-section view of the second cylindrical member.
Figure 3:
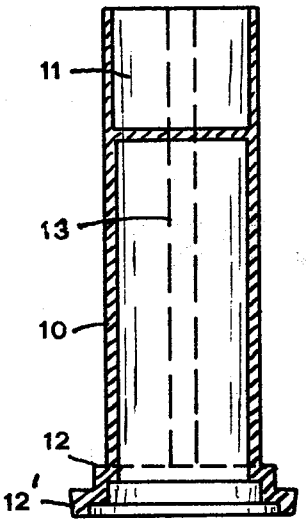
FIG. 3 is a cross-section view of the innermost first cylindrical member acting as a supporting member for the stick of the product to be housed.

For assembling the container according to the present invention, the end of the product C is inserted in the small cup (11), the cylindrical members are coaxially threaded into one another (see FIG. 6), in such a way that the nose member (13) of the cylindrical member (10) inserts into the corresponding seat (15) of the cylindrical member (14) and the nose members (16) and (16') of said cylindrical member (14) insert into the respective helical slot (17) and (17') of the cylindrical member (18). Finally the cylindrical member (20) is inserted, locating and making rigid the step (12') in the recess (21') and causing the step (19) to slide in the recess (21).

The operation of the cylindrical container according to the present invention is the following: maintaining stationary the cylindrical member (20) and rotating, in the clockwise and anti-clockwise direction, the cylindrical member (18), the cylindrical member (14) is caused to axially lower or raise. Accordingly, the product stick C remain always stationary and is uncovered or covered by the cylindrical member (14) depending on the rotation direction imposed onto said cylindrical member (18).

Modifications, changes and variations may be carried out to the cylindrical container illustrated in the figures within the spirit of the present invention and without depaeting from the scope thereof.

I claim:

1. A cylindrical container particularly suitable for containing lip-sticks, cocoa-butter, shaving-soap or sticks and the like cosmetical products, characterized in that it consists of four coaxial hollow cylindrical members, inserted into one another and effective to mutually slide, in which:

the first cylindrical member, the innermost one, is provided, at the upper portion thereof, with a small cup for containing the lower portion of the product to be housed and, laterally, axially and all along the length thereof, with a projecting nose;

the second cylindrical member has an inner diameter greater than the outer diameter of the first cylindrical member thereby keying thereonto, and it is provided, on the inner surface thereof, axially and all along the length thereof, with a slot thereinto inserts and therethrough slides the projecting nose of the first cylindrical member and, on the outer surface thereof, diametrically and at the lower end thereof, with two projecting and slanted nose members;

the third cylindrical member has an inner diameter greater than the outer diameter of the second cylindrical member, thereby keying onto this latter, behind provided, on the inner surface thereof, which two helical slots crossing one another, in each slot inserting one of the two projecting nose members of said second cylindrical member, and the fourth cylindrical member, acting as the handle of the container, having an inner diameter greater than the outer diameter of the third cylindrical member, and having a height lower than that of said cylindrical members and being fixed to the lower portion of the first cylindrical member.

2. A cylindrical container according to claim 1, characterized in that the lower portion of the first cylinder is provided with a perimetrical collar formed by two steps having different and outwardly increasing diameters and in that the lower portion of the third cylindrical member is provided with two perimetrical recesses of which the outermost one fits together and is fixed onto the outermost step of the first cylindrical member.

3. A cylindrical container according to claim 1 or 2, characterized in that the base of the third cylindrical member is provided with a perimetrical step inserted in the innermost perimetrical recess of the fourth cylindrical member and sliding therethrough.

4. A cylindrical container according to claim 1 or 2, characterized in that the inner diameter of the third cylindrical member is equal to or slightly greater than the outer diameter of the innermost step of the first cylindrical member.

5. A cylindrical container according to claim 4, characterized in that the fourth cylindrical member is provided, at the upper portion and outer surface thereof, with a perimetrical recess or groove thereonto is pressure keyed the covering member.

* * * * *